United States Patent [19]

Stokes

[11] 4,393,562

[45] Jul. 19, 1983

[54] APPARATUS FOR IMPARTING VISUAL SURFACE EFFECTS TO RELATIVELY MOVING MATERIALS

[75] Inventor: Jimmy L. Stokes, Moore, S.C.

[73] Assignee: Milliken Research Corporation, Spartanburg, S.C.

[21] Appl. No.: 227,828

[22] Filed: Jan. 23, 1981

[51] Int. Cl.[3] ..... D06C 23/00

[52] U.S. Cl. ..... 26/2 R; 26/69 R; 26/69 A; 28/160; 28/163

[58] Field of Search ..... 26/2 R, 3, 69 A, 69 R; 28/160, 163

[56] References Cited

U.S. PATENT DOCUMENTS

| | | | |
|---|---|---|---|
| 2,110,118 | 3/1938 | Robertson et al. . | |
| 3,443,878 | 5/1969 | Weber et al. . | |
| 3,721,517 | 3/1973 | Osthoff | 26/3 X |
| 4,323,760 | 4/1982 | Greenway et al. | 26/2 R X |
| 4,364,156 | 12/1982 | Greenway et al. | 26/2 R |

FOREIGN PATENT DOCUMENTS

| | | | |
|---|---|---|---|
| 275696 | 8/1927 | United Kingdom | 26/3 |
| 1063252 | 3/1967 | United Kingdom . | |
| 2098249A | 1982 | United Kingdom | |

*Primary Examiner*—Robert Mackey

*Attorney, Agent, or Firm*—George M. Fisher; H. William Petry

[57] ABSTRACT

Improved apparatus for imparting visual surface effects to a relatively moving substrate material by application of discrete streams of heated pressurized fluid to surface areas of the material. The apparatus includes an elongate manifold assembly disposed across the path of relative movement of the material and comprising a pair of elongate manifold housings which are coupled by quick release clamping means in fluid tight relation to facilitate pattern changes and maintenance of the treating apparatus. The manifold housings are constructed and arranged so that any distortion of the manifold assembly caused by differential thermal expansion of the same is resolved to minimize displacement of the manifold toward or away from the substrate. Baffle means, filter means, and fluid passageways are provided in the manifold assembly to evenly distribute the heated air at uniform temperature throughout the full length of the assembly.

13 Claims, 8 Drawing Figures

APPARATUS FOR IMPARTING VISUAL SURFACE EFFECTS TO RELATIVELY MOVING MATERIALS

This invention relates to improved apparatus for pressurized heated fluid stream treatment of relatively moving materials to provide visual surface effects therein, and, more particularly, to improved apparatus for precise selective application of discrete, high temperature, pressurized streams of air or gaseous materials against the surface of a themally modifiable, relatively moving substrate material, such as a textile fabric containing thermoplastic yarn or fiber components, to thermally modify the same and impart a visual change and/or pattern effect therein.

BACKGROUND OF THE INVENTION

Various apparatus have been proposed for directing heated pressurized fluid streams, such as air or steam, into the surface of moving textile fabrics to alter the location of or modify the thermal properties of fibers or yarns therein and provide a pattern or visual surface change in such fabrics. Examples of such prior art equipment and methods of application of the pressurized fluid streams to a relatively moving material are disclosed in the following U.S. Pat. Nos.:

U.S. Pat. No. 2,110,118
U.S. Pat. No 2,241,222
U.S. Pat. No. 2,563,259
U.S. Pat. No. 3,010,179
U.S. Pat. No. 3,403,862
U.S. Pat. No. 3,434,188
U.S. Pat. No. 3,585,098
U.S. Pat. No. 3,613,186.

It is believed that such prior art treatment devices as described in the aforementioned patents, because of the nature of the equipment disclosed, are not capable of producing precise, intricate, or well defined patterns of wide variety in the fabrics, but generally can only produce limited, relatively grossly defined patterns, or surface modifications of a random, non-defined nature in the materials. In utilizing high temperature pressurized streams of fluid, such as air, to impart visual surface patterns to textile fabrics containing thermoplastic materials by thermal modification of the same, it can be appreciated that highly precise control of stream pressure, temperature, and direction is required in all of the individual heated streams striking the fabric to obtain uniformity and preciseness in the resultant pattern formed in the fabric. In addition, there are ever present difficulties in regulating the flow of high temperature fluid streams by use of conventional valving systems to selectively cut the stream flow on or off in accordance with pattern control information.

More recently, apparatus has been developed for more precisely and accurately controlling and directing high temperature streams of pressurized fluid, such as air, against the surface of a relatively moving substrate material, such as a textile fabric containing thermoplastic yarns, to impart intricate patterns and surface changes thereto. Such apparatus includes an elongate pressurized heated air distributing manifold having a narrow elongate air discharge slot extending across the path of fabric movement in close proximity to the fabric surface. Located within the manifold is a shim plate having a notched edge which resides in the discharge slot to form parallel spaced discharge channels through which the heated pressurized air passes in narrow, precisely defined streams to impinge upon the adjacent surface of the fabric. Flow of the individual heated air streams from the channels is controlled by the use of pressurized cool air which is directed by individual cool air supply tubes communicating with each channel to direct cool air into each discharge channel at a generally right angle to its discharge axis to block the passage of heated air therethrough. Each cool air tube is provided with an individual valve and the valves are selectively cut on and off in response to signal information from a pattern source, such as a computer program, to allow the heated air streams to strike the moving fabric in selected areas and impart a pattern thereto by thermal modification of the yarns.

To maintain more uniform temperature in the individual heated air streams along the full length of the distributing manifold, pressurized air is supplied to the distributing manifold through a bank of individual electric heaters which communicate with the manifold at uniformly spaced locations along its length and are regulated to introduce heated air at the desired temperature along the full length of the manifold.

Although such apparatus as described above provides for highly precise and intricate hot air patterning of substrate materials, in handling and distributing the high temperature air, a temperature drop occurs in the heated air during its passage through the manifold from the heater source to its point of discharge from the manifold. This temperature drop causes differential thermal expansion of the manifold housing which results in a displacement or bending of the manifold along its longitudinal axis. Such distortions become magnified in proportion to the length of the manifold, and present a serious problem when the distortions cause a variation in the distances of the manifold discharge outlets from the surface of the substrate material. If certain of the discharge outlets along the manifold are moved away from the substrate, the temperature, pressure, and preciseness of their streams striking the fabric will be reduced, resulting in a non-uniform patterning of the substrate across its width. Correspondingly, if certain of the manifold discharge outlets are moved closer to the substrate surface due to thermal distortion of the manifold, pattern variatins are again produced across the substrate. Additionally, the substrate may be damaged by overheating due to high temperature of the streams striking the substrate or by direct contact of the substrate with the hot manifold.

OBJECTS OF THE PRESENT INVENTION

It is therefore an object of the present invention to provide improved apparatus of the type hereinabove described for directing high temperature pressurized fluid streams into the surface of a relatively moving substrate material to impart a precise visual pattern or surface appearance thereto.

It is another object to provide an improved heated pressurized fluid distributing manifold for directing pressurized streams of fluid, such as high temperature air, into the surface of a moving substrate across the full width of its path of movement, and wherein the flow of heated pressurized fluid through the manifold is directed to improve uniformity of pressure and temperature in the individual streams discharged from the manifold.

It is a further object to provide an elongate heated fluid distributing manifold wherein displacement of the manifold due to thermal expansion and contraction is controlled and directed so as to minimize pattern distortion and damage to substrate materials being treated thereby.

It is another object to provide an improved heated fluid stream treating apparatus wherein the patterning manifold is constructed to facilitate rapid pattern changes and perform routine maintenance on the apparatus.

BRIEF DESCRIPTION OF THE INVENTION

Briefly, the present invention comprises improved fluid distributing manifold means for directing discrete streams of pressurized heated fluid, such as hot air, into the surface of a relatively moving substrate, in particular substrate materials containing thermoplastic components, to impart a precise pattern or surface change thereto. The manifold means comprises a pair of elongate manifold housings coupled together and defining respective first and second pressurized fluid-receiving compartments. Heated fluid is supplied to the first elongate manifold housing compartment through multiple inlets, uniformly spaced along its length, and the heated fluid passes through the first housing compartment in a particularly directed path generally perpendicular to its length to facilitate uniform distribution and temperature in the fluid along the length of the housing. The heated fluid from the first housing passes into the second elongate housing compartment which is provided with pressurized fluid discharge outlet channels spaced in parallel relation along the length of the housing to direct streams of fluid generally at a right angle into the surface of the substrate material. The manifold housings are constructed and arranged so that the flow path of fluid through the first housing is generally at a right angle to the discharge axes of the fluid stream outlets of the second manifold housing.

Temperature drops in the heated air during its passage through the manifold cause differential expansion of the first manifold housing which produces a bowing or bending effect along the longitudinal length of the housing. Because of the generally symmetrical arrangement of the first manifold housing mass about a plane parallel to the predominant flow of fluid through the housing, this differential expansion tends to be similarly symmetrical. As a result, the bowing or bending effects tend to be directed in a plane generally perpendicular to the plane of the discharge outlets of the heated air streams, and therefore parallel to the surface of the substrate. Thus, the displacement of the manifold is resolved in a plane so as to minimize any movement of the discharge outlets toward or away from the substrate, eliminating resultant patterning irregularities in the treated substrate caused by such forces.

The first manifold housing is provided with baffle means, fluid passageways, and filter means to evenly distribute the fluid along the length of the housing and filter the same during its passage through the housing. Quick-release clamping means are provided for supportably attaching the second housing to the first housing to permit its quick removal and replacement during pattern changes and maintenance of the apparatus.

BRIEF DESCRIPTION OF THE DRAWINGS

Objects and details of the invention will be better understood from the following detailed description of preferred embodiments thereof, when taken together with the accompanying drawings, in which.

DETAILED DESCRIPTION OF PREFERRED EMBODIMENTS

Figure 1:
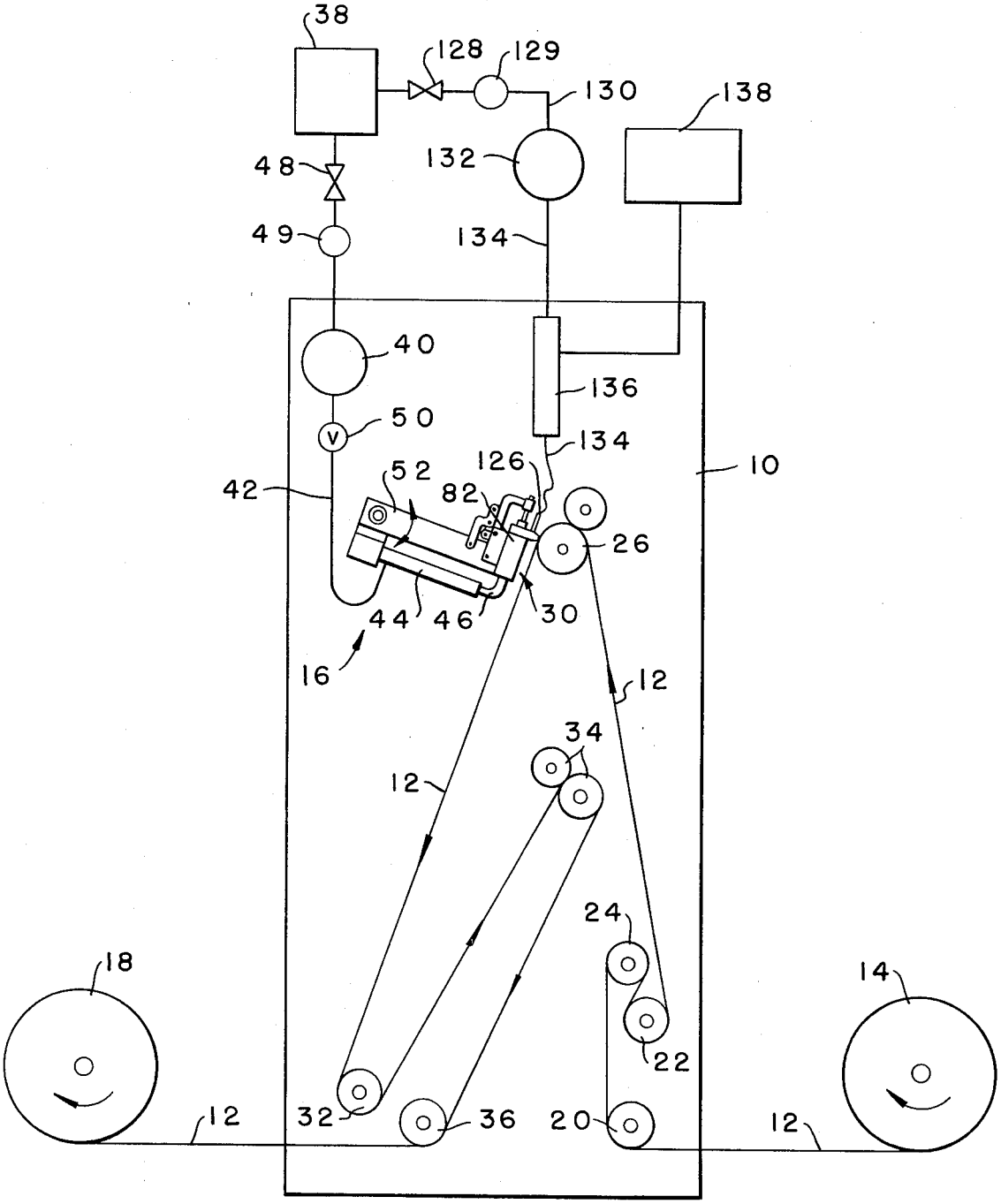
FIG. 1 is a schematic side elevation view of apparatus for pressurized heated fluid stream treatment of a moving substrate material to impart a surface pattern or change in the surface appearance thereof, and incorporating novel features of the present invention.

Referring more specifically to the drawings, FIG. 1 shows, diagrammatically, an overall side elevation view of apparatus for pressurized heated fluid stream treatment of a moving substrate material to impart a pattern or visual change thereto. As seen, the apparatus includes a main support frame including end frame support members, one of which 10 is illustrated in FIG. 1. Suitably rotatably mounted on the end support members of the frame are a plurality of substrate guide rolls which direct an indefinite length substrate material, such as a textile fabric 12, from a fabric supply roll 14, past a pressurized heated fluid treating unit, generally indicated at 16. After treatment, the fabric is collected in continuous manner on a take-up roll 18. As shown, fabric 12 from supply roll 14 passes over an idler roll 20 and is fed by a pair of driven rolls 22, 24 to a main driven fabric support roll 26 to pass the surface of the fabric closely adjacent the heated fluid discharge outlets of an elongate fluid distributing manifold assembly 30 of treating unit 16. The treated fabric 12 thereafter passes over a series of driven guide rolls 32, 34 and an idler roll 36 to take up roll 18 for collection.

As illustrated in FIG. 1, fluid treating unit 16 includes a source of compressed fluid, such as an air compressor 38, which supplies pressurized air to an elongate air header pipe 40. Header pipe 40 communicates by a series of air lines 42 spaced uniformly along its length with a bank of individual electrical heaters indicated generally at 44. The heaters 44 are arranged in parallel along the length of manifold assembly 30 and supply heated pressurized air thereto through short, individual air supply lines, indicated at 46, which communicate with assembly 30 uniformly along its full length. Air supply to the fluid distributing manifold assembly is controlled by a master control valve 48, pressure regulator valve 49, and individual precision control valves, such as needle valves 50, located in each heater air supply line 42. The heaters are controlled in suitable manner, as by temperature sensing means located in the outlet lines 46 of each heater, with regulation of air flow and electrical power to each of the heaters to maintain the heated fluid at a uniform temperature and pressure as it passes into the manifold assembly along its full length. Typically, for patterning textile fabrics, such as pile fabrics containing thermoplastic pile yarns, the heaters are employed to heat air exiting the heaters and entering the manifold assembly to a uniform temperature of about 700° F.–750° F.

The heated fluid distributing manifold assembly 30 is disposed across the full width of the path of movement of the fabric and closely adjacent the surface thereof to be treated. Although the length of the manifold assembly may vary, typically in the treatment of textile fabric materials, the length of the manifold assembly may be 76 inches or more to accommodate fabrics of up to about 72 inches in width.

Figure 7:
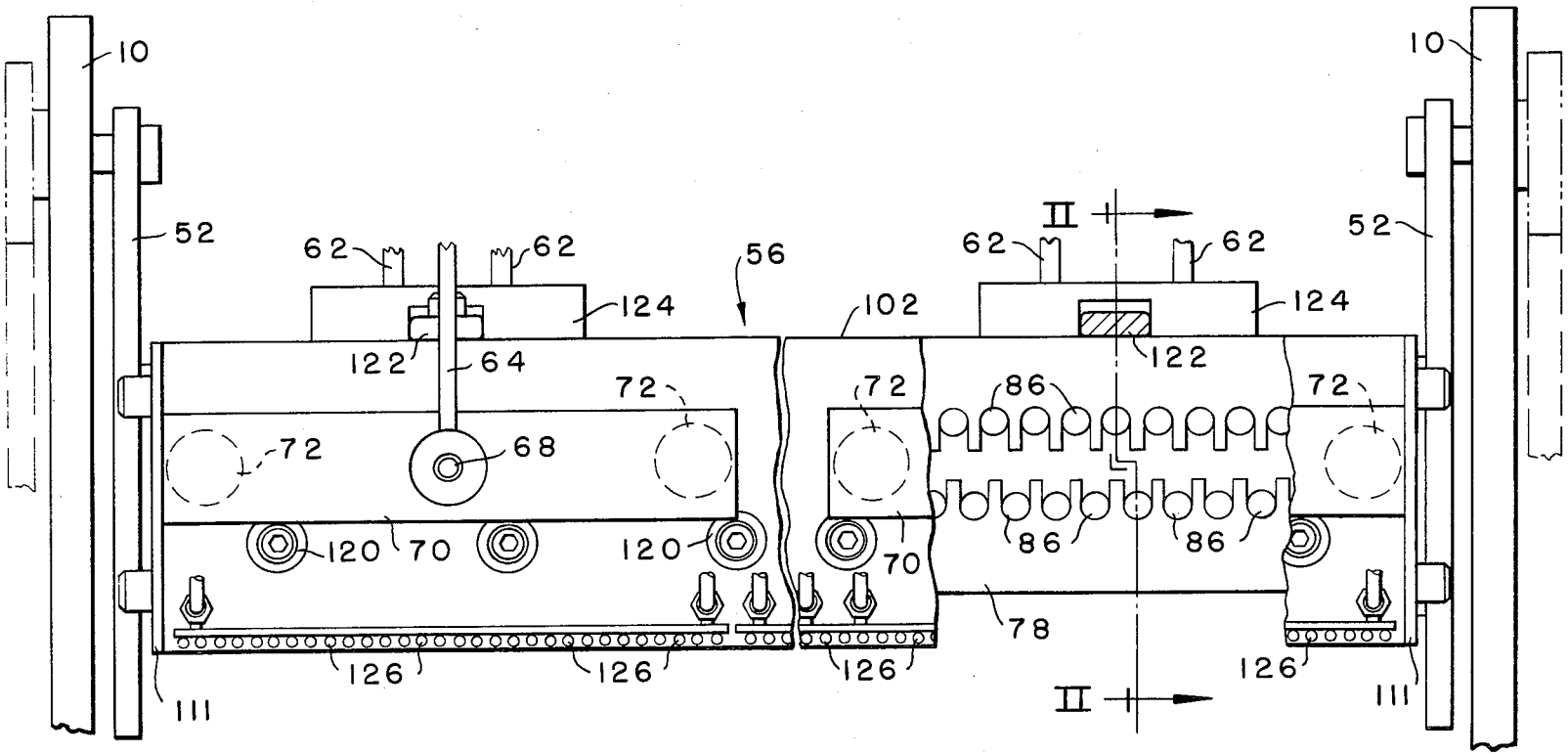
FIG. 7 is an enlarged plan view of end portions of the manifold assembly, taken generally along line VII—VII of FIG. 2 and looking in the direction of the arrows.

As illustrated in FIG. 1 and in FIG. 7, the elongate manifold assembly 30 and the bank of heaters 44 are supported at their ends on the end frame support members 10 of the main support frame by support arms 52 which are pivotally attached to end members 10 to permit movement of the assembly 30 and heaters 44 away from the surface of the fabric 12 and fabric supporting roller 26 during periods when the movement of the fabric through the treating apparatus may be stopped.

Figure 2:
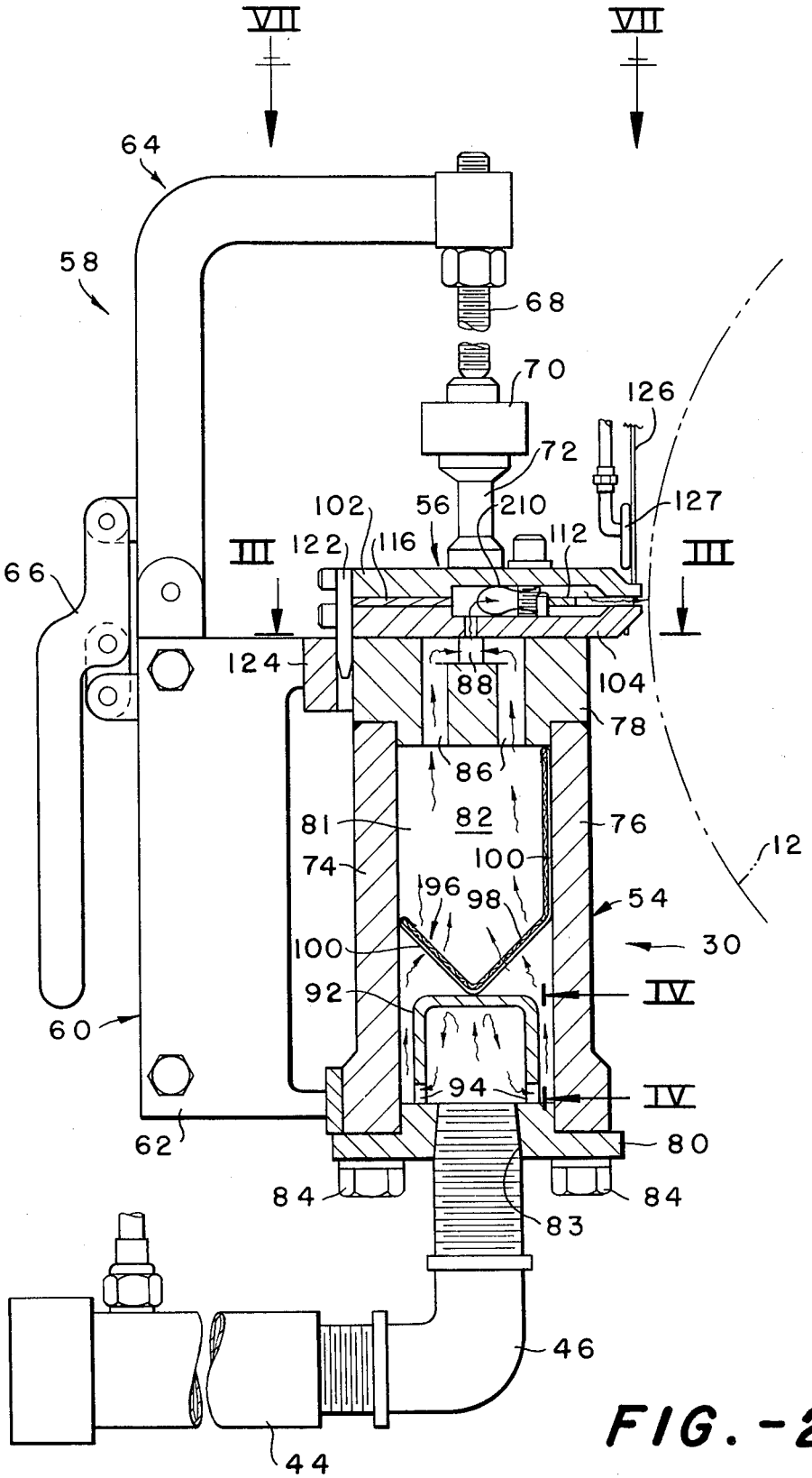
FIG. 2 is an enlarged partial sectional elevation view of the fluid distributing manifold assembly of the apparatus of FIG. 1, taken along a section line of the manifold assembly indicated by the line II—II in FIG. 7.

Details of the improved heated fluid distributing manifold assembly of the present invention may be best described by reference to FIGS. 2–8 of the drawings. As seen in FIG. 2, which is a partial sectional elevation view through the assembly, taken along line II—II of FIG. 7, the manifold assembly 30 comprises a first large elongate manifold housing 54 and a second smaller elongate manifold housing 56 secured in fluid tight relationship therewith by a plurality of spaced clamping means, one of which is generally indicated at 58. The manifold housings 54, 56 extend across the full width of the fabric 12 adjacent its path of movement. Clamping means 58 comprises a plurality of manually-operated clamps 60 spaced along the length of the housings. Each clamp includes a first portion 62 fixedly attached, as by welding, to the first manifold housing 54, and a second movable portion 64 pivotally attached to fixed portion 62 by a manually operated handle and linkage mechanism 66. Second portion 64 of clamp 60 includes an adjustable threaded screw and bolt assembly 68 with elongate presser bars 70 which apply pressure to manifold housing 56 through a plurality of spacer blocks 72 which are attached to the surface of housing 56 at spaced locations along its length (FIG. 7).

As best seen in FIG. 2, first elongate manifold housing 54 is of generally rectangular cross-sectional shape, and includes a pair of spaced plates forming side walls 74, 76 which extend across the full width of the path of fabric movement, and elongate top and bottom wall plates 78, 80 which define a first elongate fluid receiving compartment 81, the ends of which are sealed by end wall plates 82 suitably bolted thereto. Communicating with bottom wall plate 80 through fluid inlet openings 83 (FIG. 4) spaced uniformly therealong are the air supply lines 46 from each of the electrical heaters 44. The side walls 74, 76 of the housing are connected to top wall plate 78 in suitable manner, as by welding, and the bottom wall plate 80 is removably attached to side walls 74, 76 by bolts 84 to permit access to the fluid receiving compartment. The plates and walls of the housing 54 are formed of suitable high strength material, such as stainless steel, or the like.

The manifold housings 54, 56 are constructed and arranged so that the flow path of fluid through the first housing 54 is generally at a right angle to the discharge axes of the fluid stream outlets of the second manifold housing 56. In addition, the mass comprising side walls 74, 76 and top and bottom wall plates 78, 80 of first manifold housing 54 is substantially symmetrically arranged on opposing sides of a plane bisecting the first fluid receiving compartment 81 in a direction parallel to the elongate length of manifold housing 54 and parallel to the predominant direction of fluid flow, i.e., from inlet openings 83 to passageways 86, through the housing compartment 81. Because the mass of the first housing 54 is arranged in a generally symmetrical fashion with respect to the path of the heated fluid through the housing compartment 81, thermal gradients and the resulting thermally-induced distortions in the first housing 54 also tend to be similarly symmetrical. As a consequence, any distortion of the manifold assembly caused by expansion and contraction due to temperature differentials tends to be resolved in a plane generally parallel to the surface of the textile fabric 12 being contacted by the heated fluid streams. This resolution of movement of the manifold assembly minimizes any displacement of the manifold discharge outlet channels 115 toward or away from the fabric 12 as a result of non-uniform thermal expansion of the manifold assembly. Any remaining unresolved thermally-induced displacement of the manifold housing 54 may be corrected by use of jacking members or other means to supply corrective forces directly to the manifold housing.

Figure 3:
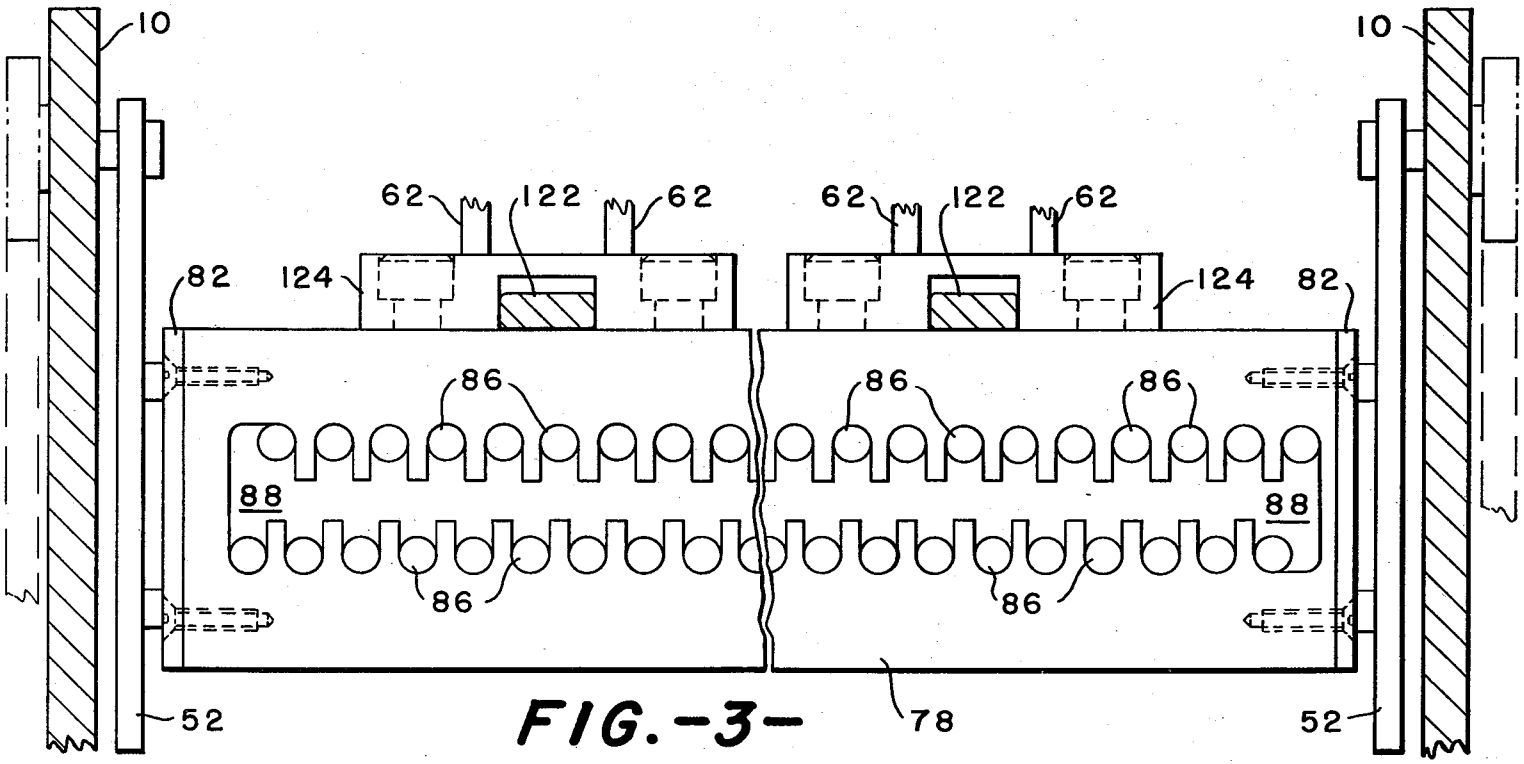
FIG. 3 is an enlarged sectional view of end portions of the elongate manifold assembly, taken generally along line III—III of FIG. 2 and looking in the direction of the arrows.

As best seen in FIGS. 2, 3 and 7, upper wall plate 78 of manifold housing 54 is of relatively thick construction and is provided with a plurality of fluid flow passageways 86 which are disposed in uniformly spaced relation along the plate in two rows to communicate the first fluid receiving compartment 81 with a central elongate channel 88 in the outer face of plate 78 which extends between the passageways along the length of the plate. As seen in FIGS. 3 and 7, the passageways in one row are located in staggered, spaced relation to the passageways in the other row to provide for uniform distribution of pressurized air into the central channel 88 while minimizing strength loss of the elongate plate 78 in the overall manifold assembly.

Figure 4:
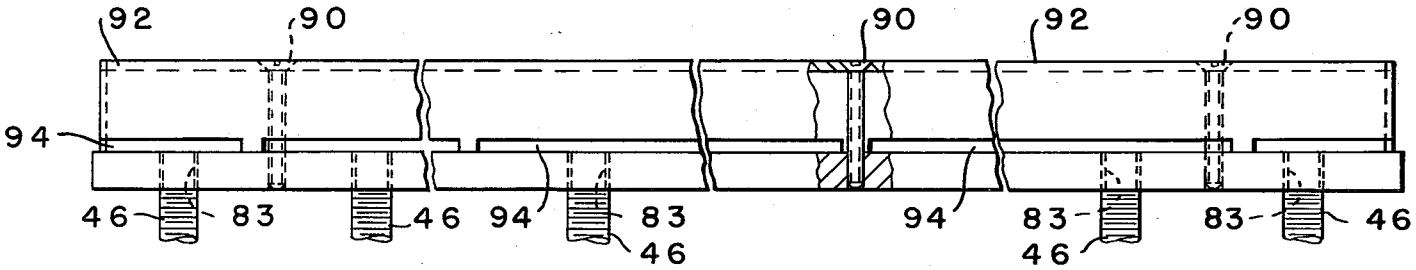
FIG. 4 is an enlarged side elevation view of end portions of the elongate baffle member of the manifold assembly, looking in the direction of arrows IV—IV of FIG. 2.

As seen in FIGS. 2 and 4, located in first fluid receiving compartment 81 and attached to the bottom wall plate 80 of the housing 54 by threaded bolts 90 is an elongate channel-shaped baffle plate 92 which extends along the length of the compartment 81 in overlying relation to wall plate 80 and the spaced, fluid inlet openings 83. Baffle plate 92 serves to define a fluid receiving chamber in the compartment 81 having side openings or slots 94 adjacent wall plate 80 to direct the incoming heated air from the bank of heaters in a generally reversing path of flow through compartment 81. As seen in FIG. 2, disposed above channel-shaped baffle plate 92 in compartment 81 between the fluid inlet openings 83 and fluid outlet passageways 86 is an elongate filter member 96 which consists of a perforated, generally J-shaped plate 98 with filter screen 100 disposed thereabout. Filter member 96 extends the length of the first fluid receiving compartment 81 and serves to filter foreign particles from the heated pressurized air during its passage therethrough. Access to the compartment 81 by way of removable bottom wall plate 80 permits periodic cleaning and/or replacement of the filter member, and the filter member is maintained in position in the compartment 81 by frictional engagement with the side walls 74, 76 to permit its quick removal from and replacement in the compartment 81.

Figure 5:
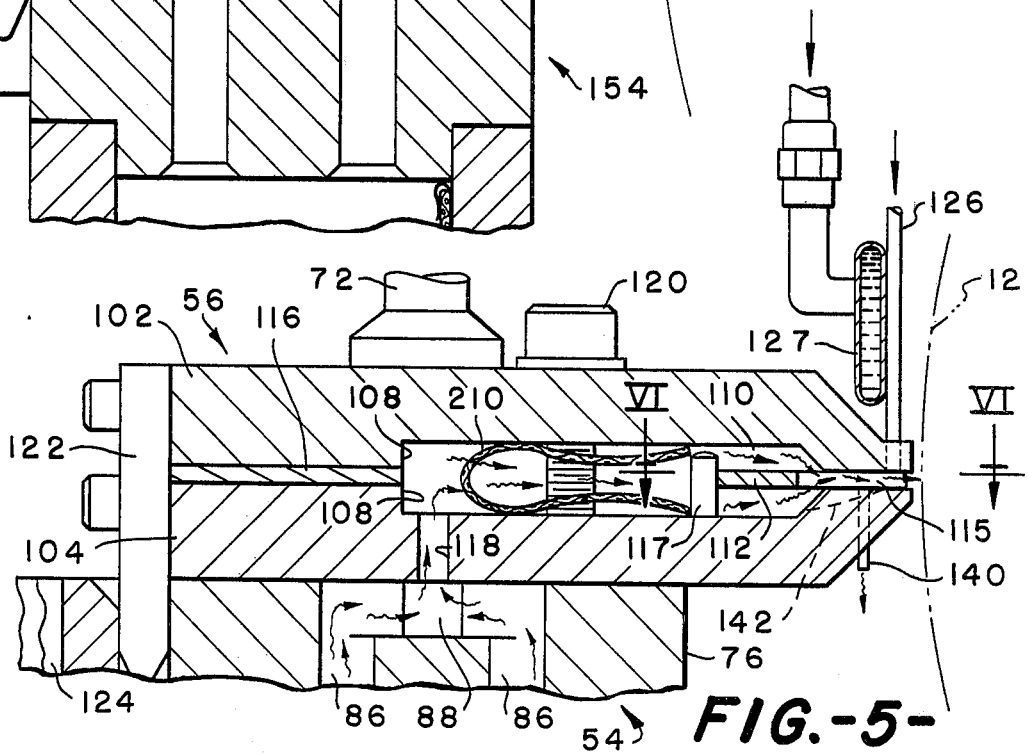
FIG. 5 is an enlarged broken away sectional view of the fluid stream distributing manifold housing portion of the manifold assembly as illustrated in FIG. 2.
Figure 6:
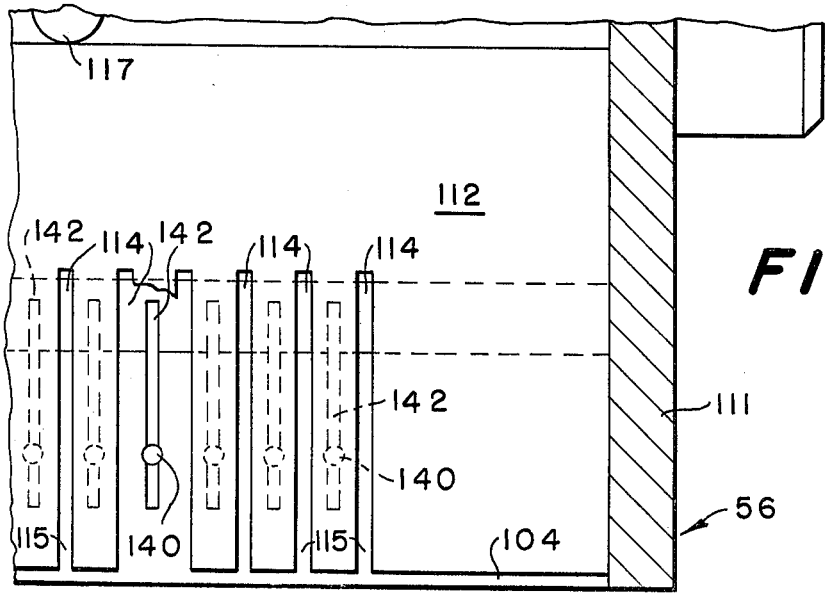
FIG. 6 is an enlarged broken away plan view of an end portion of the fluid stream distributing manifold housing looking in the direction of the arrows VI—VI of FIG. 5.

As best seen in FIGS. 2 and 5, second smaller manifold housing 56 comprises first and second opposed elongate wall members 102, 104, each of which has an elongate recess or channel 108 therein. Wall members 102, 104 are disposed in spaced, coextensive parallel relation with their channels 108 in facing relation to form upper and lower wall portions of a second fluid receiving compartment 110, in the second manifold housing 56. Ends of the second fluid receiving compartment 110 are closed by end plates 111 (FIG . 7). The opposed wall members 102, 104 are maintained in spaced relation by an elongate front shim plate 112 which has a plurality of parallel, elongate notches 114 (FIG. 6 ) in one side edge thereof, and a rear elongate shim plate 116 disposed between the opposed faces of the wall members 102, 104 in fluid tight engagement therewith. As seen in FIGS. 5 and 6, the notched edge of shim plate 112 is disposed between the first and second wall members along the front elongate edge portions thereof to form, with wall members 102, 104, a plurality of parallel heated fluid discharge outlet channels which direct heated pressurized air from the second fluid receiving compartment 110 in narrow, discrete streams at a substantially right angle into the surface of the moving fabric substrate material 12. Dowel pins 117 in second compartment 110 facilitate alignment of shim plate 112 between wall members 102, 104. Typically, in treatment of textile fabrics, such as pile fabrics containing thermoplastic pile yarn or fiber components, the discharge channels of manifold 56 may be 0.012 inch wide and uniformly spaced on 0.1 inch centers, with 756 discharge channels being located in a row along a 76 inch long manifold assembly. For precise control of the heated air streams striking the fabric, the discharge outlet channels are preferably maintained between about 0.020 to 0.030 inch from the fabric surface being treated.

Lower wall member 104 of the second manifold housing 56 is provided with a plurality of fluid inlet openings 118 which communicate with the elongate channel 88 of the first manifold housing 54 along its length to receive pressurized heated air from the first manifold housing 54 into the second fluid receiving compartment 110. Wall members 102, 104 of the second manifold housing 56 are connected at spaced locations by a plurality of threaded bolts 120, and the second manifold housing 56 is maintained in fluid tight relation with its shim members and with the elongate channel 88 of the first manifold housing 54, by the adjustable clamps 60. Guide means, comprising a plurality of short guide bars 122 attached to the second manifold housing 56 and received in guide bar openings in brackets 124 attached to the first manifold housing 54, ensure proper alignment of the first and second manifold housings during their attachment by the quick-release clamps 60.

As seen in FIGS. 1, 2 and 5 of the drawings, each of the heated fluid discharge outlet channels of the second manifold housing 56 which direct streams of air into the surface of fabric 12 is provided with a tube 126 which communicates at a right angle to the axis of the discharge channel to introduce pressurized cool air, i.e., air having a temperature substantially below that of the heated air in second fluid receiving compartment 110, into the heated fluid discharge outlet channel to selectively block the flow of heated air through the channel in accordance with pattern control information. Air passing through the tubes 126 may be cooled by a water jacket 127. As seen in FIG. 1, pressurized unheated air is supplied to each of the tubes 126 from compressor 38 by way of a master control valve 128, pressure regulator valve 129, air line 130, and unheated air header pipe 132 which is connected by a plurality of individual air supply lines 134 to the individual tubes 126. Each of the individual cool air supply lines 134 is provided with an individual control valve located in a valve box 136. These individual control valves are operated to open or close in response to signals from a pattern control device, such as a computer 138, to stop the flow of hot air through selected discharge channels during movement of the fabric and thereby produce a desired pattern in the fabric. Detailed patterning information for individual patterns may be stored and accessed by means of any known data storage medium suitable for use with electronic computers, such as magnetic tape, EPROMs, etc.

As seen in FIGS. 5 and 6, located between each of the heated fluid discharge channels, in the front edge of lower wall member 104 of the housing 56, is a heated fluid discharge outlet tube 140 which communicates by a passageway 142 with compartment 110 of the housing 56 and provides continuous bleed off of a small portion of heated fluid to maintain shim plate 112 and wall portions of the housing adjacent the discharge channels heated.

Figure 8:
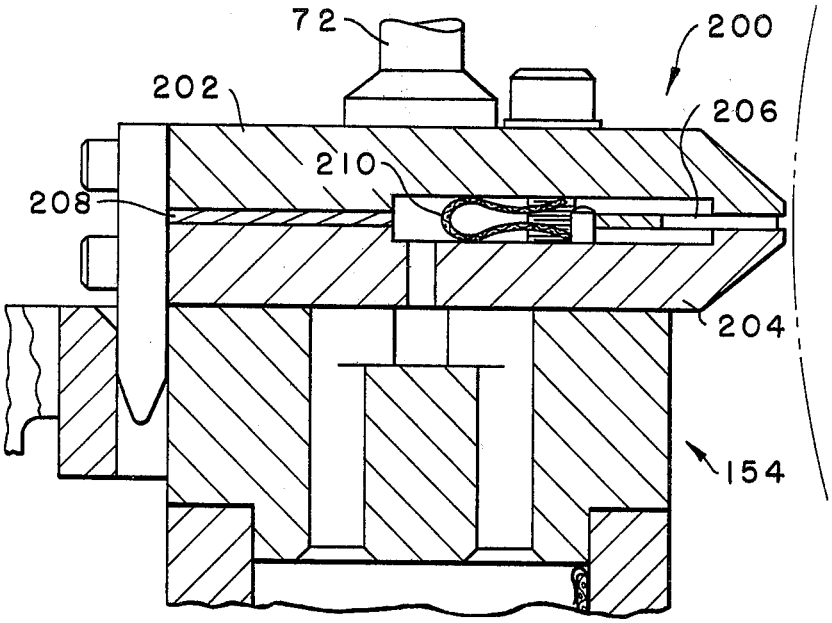
FIG. 8 is an enlarged sectional elevation view of a modified form of fluid distributing manifold housing from that shown in FIGS. 1–7.

FIG. 8 shows a modified form of manifold assembly from that shown in FIGS. 1–7 wherein a second manifold housing 200 without cooling tubes is employed in the manifold assembly to pattern the substrate material. The construction and attachment of the manifold housing 200 to the main housing 154 is substantially identical to the fluid distributing manifold housing 56 of FIGS. 1–7 with the exception of cooling tubes for blocking discharge of the heated fluid from the manifold channels. Housing 200 includes upper and lower elongate wall members 202, 204 with notched shim plate 206 and rear shim plate 208 defining the hot fluid receiving compartment therein. The notches of shim plate 206 are spaced at desired locations along the edge of the plate to produce a pattern of continuous stripes along the length of the moving substrate, and stripe pattern changes may be affected by quick release of the manifold housing 200 from the main manifold housing 154 and replacement of the shim plate 206 therein with shim plates having other notch pattern configurations.

By the use of front and back shim plates between the upper and lower wall members of the manifold housing 56 as illustrated in the embodiment of FIGS. 1–7, or 200 as indicated in the modification shown in FIG. 8 thereof, the sealing surfaces of the upper and lower wall members may be smoothly machined in a single machining operation to ensure fluid tight seal of the housing compartment. The use of two shims of equal thickness to seal the manifold housing compartment also permits the use of notched shim plates of different thicknesses to vary the cross-sectional dimension size of the discharge channels, as desired, without having to provide a different manifold housing construction to accommodate pattern shim plates of different thicknesses.

As seen in FIGS. 2, 5, and 8, an additional elongate filter medium or screen 210 may be disposed in the second fluid receiving compartment of the manifold assembly to facilitate filtration and distribution of the pressurized heated air prior to its discharge onto the moving substrate material.

As can be understood from the foregoing detailed description of preferred embodiments of the invention, the manifold assembly comprising first and second manifold housings provides a heated pressurized fluid flow path from the bank of heaters which passes through the first manifold housing in a direction generally perpendicular to its elongate length and perpendicular to the axes of discharge of the pressurized fluid streams from the second fluid receiving compartment. Such passage provides uniform distribution of the heated fluid, such as air, in the manifold assembly prior to its discharge onto the fabric substrate. Typically, it has been found that during passage of heated air from the heaters through the first manifold housing to achieve the desired mixing of the air, temperature drops of as much as 100° F. occur in the air stream. This temperature drop causes differential expansion of the first manifold housing which produces a bowing or bending effect along its longitudinal length which is directed by the arrangement and configuration of the manifold assembly in a plane generally parallel to the surface of the fabric substrate and perpendicular to the plane of the discharge axes of the streams from the second manifold housing. Thus, the displacement of the assembly is resolved in a plane so as to minimize any movement of the discharge outlets of the second housing toward or away from the fabric, eliminating resultant patterning irregularities in the treated fabric caused by such forces.

That which I claim is:

1. In apparatus for pressurized heated fluid stream treatment of a relatively moving substrate material to impart a change in the appearance thereof and including an elongate fluid distributing manifold assembly disposed across the path of relative movement of the material and closely adjacent the surface thereof for discharging at least one discrete stream of heated pressurized fluid against the surface of the material; the improvement wherein said manifold assembly comprises first and second elongate manifold housings defining corresponding first and second fluid-receiving compartments extending across the path of relative movement of the material;

said first housing including inlet means for introducing pressurized heated fluid into said first compartment generally uniformly along its elongate length, outlet means located remotely from said inlet means for discharging heated fluid from the compartment generally uniformly along its elongate length, said first housing inlet and outlet means defining a flow path through said housing which is generally perpendicular to its length, the axis of fluid flow introduced into said first compartment by said inlet means and the axis of fluid flow discharged from said first compartment by said outlet means being substantially parallel;

said second manifold housing including inlet means for receiving pressurized heated fluid into said second compartment generally uniformly along its length, fluid stream discharge outlet means in said second housing for directing said at least one stream of fluid against the surface of the substrate material, said second housing inlet and outlet means defining a flow path of heated fluid through said housing which is generally perpendicular to its length;

and means attaching said second housing to said first housing, with said outlet means of said first housing communicating with said inlet means of said second housing, and with the axis of discharge of said fluid stream discharge outlet means disposed at a substantially right angle to the heated fluid flow path through said first manifold housing.

2. Apparatus as defined in claim 1 wherein said means attaching said second housing to said first housing comprises quick-release clamping means for supportably securing said second housing to said first housing to facilitate replacement and maintenance of component parts of said second manifold housing.

3. Apparatus as defined in claim 1 including baffle means in said first housing compartment disposed between said inlet and outlet means thereof for reversing the path of flow of fluid through the compartment during its passage therethrough.

4. Apparatus as defined in claim 3 wherein said first housing inlet means comprises a plurality of inlet openings generally uniformly spaced along the length of the housing through a wall portion thereof, and said baffle means comprises an elongate channel-shaped plate extending along the length of said first housing compartment in overlying relation to said wall portion and said inlet openings to define a fluid-receiving chamber in said compartment having side openings adjacent said wall portion and along the length of the housing to direct incoming heated fluid in said reversing path of flow through the compartment.

5. Apparatus as defined in claim 1 including filter means removably disposed in said first housing compartment along the length thereof and between said inlet means and outlet means to remove contaminants from the heated fluid passing therethrough.

6. Apparatus as defined in claim 5 wherein said filter means comprises a perforate screen spanning said compartment along its length and frictional engaging side wall portions of the housing to permit its ready removal therefrom for maintenance of the apparatus.

7. Apparatus as defined in claim 1 wherein the mass of said first elongate manifold is substantially symmetrically arranged on opposite sides of a plane which bisects said first fluid receiving compartment in a direction parallel to the elongate length of said first compartment and parallel to the predominant direction of fluid flow through said first fluid receiving compartment.

8. Apparatus as defined in claim 7 wherein said second manifold housing comprises first and second opposed elongate wall members each having an elongate channel therein, said wall members being disposed in spaced coextensive parallel relation with their channels in facing relation to form upper and lower wall portions of said second fluid-receiving compartment, a first elongate shim plate having a plurality of generally parallel notches spaced along an elongate side edge thereof, the notched edge of said first shim plate being positioned between said first and second elongate wall members along an elongate edge portion thereof and in contiguous relation therewith to form said fluid stream discharge outlet means of said second housing, a second elongate shim plate positioned between said first and second wall members along the opposite elongate edge portion of said first and second elongate wall members in contiguous relation therewith, an end wall member attached to each end of said first and second wall members in fluid-tight relation with said wall members and said shim plates, and wherein said attaching means includes means for applying pressure on said first and second elongate wall members to maintain contiguous surfaces of said shim plates in fluid-tight relation therewith.

9. Apparatus as defined in claim 7 wherein said first housing outlet means comprise a plurality of passageways through a wall member of said housing, said passageways being disposed in two rows along the length of said housing with passageways in one row located in staggered relation with respect to the passageways of the other row, an elongate channel in the outer face of said wall member extending between said rows of passageways along the length of said housing, and each of said passageways communicating with said channel at generally uniformly spaced locations along its length to distribute heated air uniformly thereinto from said first housing compartment.

10. Apparatus as defined in claim 9 wherein said second housing inlet means comprises a plurality of inlet openings disposed in generally uniformly spaced relationship along the length of said housing and communicating with said elongate channel in the outer face of said first housing wall member to receive heated fluid into said second housing compartment.

11. Apparatus as defined in claim 10 wherein said first and second housings are attached by said attaching means with wall surface portions of the housings forming fluid seal engagement of said second housing inlet openings with said elongate channel in the outer face of said first housing wall member, and wherein the flow path of heated fluid through said first housing compartment is generally at a right angle to the flow path of heated fluid through said second housing compartment.

12. Apparatus as defined in claim 11 wherein said attaching means for said housings comprises quick-release clamping means having a first portion supportably secured to said first housing, and a second portion adjustably and removably engaging said second housing at spaced locations along its length to maintain said wall surface portions of said housings in fluid seal engagement for passage of heated fluid from said first housing compartment to said second housing compartment while permitting quick release of said second housing from said first housing for replacement and maintenance.

13. Apparatus as defined in claim 12 including guide means on said housings to ensure proper alignment of said housings during attachment of said second housing to said first housing by said quick-release clamping means.

* * * * *

UNITED STATES PATENT AND TRADEMARK OFFICE

CERTIFICATE OF CORRECTION

PATENT NO. : 4,393,562

DATED : July 19, 1983

INVENTOR(S) : Jimmy L. Stokes

It is certified that error appears in the above-identified patent and that said Letters Patent is hereby corrected as shown below:

Column 2, line 45,"variatins" should be "variations".

Column 2, line 47, "high" should be "higher".

Signed and Sealed this

*Twentieth* Day of *September 1983*

[SEAL]

*Attest:*

GERALD J. MOSSINGHOFF

*Attesting Officer*

*Commissioner of Patents and Trademarks*